United States Patent [19]

Garner

[11] Patent Number: 5,040,997

[45] Date of Patent: Aug. 20, 1991

[54] FLEX CIRCUIT CONNECTOR ASSEMBLY AND METHOD FOR MANUFACTURING THE SAME

[75] Inventor: Ronald N. Garner, Brockton, Mass.

[73] Assignee: The Foxboro Company, Foxboro, Mass.

[21] Appl. No.: 535,437

[22] Filed: Jun. 8, 1990

[51] Int. Cl.[5] ..... H01R 9/07; H01R 9/09; H01R 13/629

[52] U.S. Cl. ..... 439/77; 439/497; 439/633; 439/329

[58] Field of Search ..... 439/77, 64, 492–494, 439/499, 633, 329; 29/831, 834, 835, 840

[56] References Cited

U.S. PATENT DOCUMENTS

| | | | |
|---|---|---|---|
| 3,069,753 | 12/1962 | Lalmond et al. | 439/77 |
| 3,114,587 | 12/1963 | Herrmann | 439/329 |
| 3,516,046 | 6/1970 | Gettig | 439/633 |
| 3,566,340 | 2/1971 | Jayne et al. | 439/633 |
| 3,602,870 | 8/1971 | Willard | 439/329 |
| 3,696,319 | 10/1972 | Olsson | 439/77 |
| 4,125,310 | 11/1978 | Reardon, II et al. | 439/329 |
| 4,639,063 | 1/1987 | Mueller | 439/77 |
| 4,691,972 | 8/1987 | Gordon | 439/77 |
| 4,713,014 | 12/1987 | Conroy-Wass | 439/67 |
| 4,714,435 | 12/1987 | Stepanuk et al. | 439/497 |
| 4,716,500 | 12/1987 | Payne | 439/67 |
| 4,861,272 | 8/1989 | Clark | 439/77 |
| 4,871,315 | 9/1989 | Noschese | 439/67 |
| 4,902,236 | 2/1990 | Hasircoglu | 439/77 |
| 4,911,643 | 3/1990 | Perry et al. | 439/67 |
| 4,913,656 | 4/1990 | Gordon et al. | 439/77 |
| 4,917,613 | 4/1990 | Kabcide | 439/67 |
| 4,948,378 | 8/1990 | Hoshino | 439/329 |
| 4,975,068 | 12/1990 | Squires | 439/77 |

*Primary Examiner*—Paula A. Bradley

*Attorney, Agent, or Firm*—Michael L. Sheldon; Jules Jay Morris

[57] ABSTRACT

A flex circuit connector assembly of the present invention includes folding one end of a flex circuit having contact pads to form a male contact portion. The male contact portion is then inserted into a female socket of an edge connector for electrically interconnecting the contact pads of the flex circuit to mating contacts disposed in the female socket of the edge connector. The edge connector includes pins for mounting it to a receptacle of a wired circuit.

4 Claims, 1 Drawing Sheet

FLEX CIRCUIT CONNECTOR ASSEMBLY AND METHOD FOR MANUFACTURING THE SAME

This invention relates to a flex circuit connector assembly for interconnecting flexible printed boards to other wired circuits and a method for manufacturing the same.

BACKGROUND OF THE INVENTION

Generally, there are two methods for interconnecting flexible printed boards, commonly known as flex circuitry, to a rigid circuit board. The first method includes directly bonding the flex circuit to the rigid board by soldering its leads to contact pads on the boards. Disadvantages of this method include limits on the density or number of connections that can be made for a given contact area on the board and difficulties associated with inspection and cleaning of the contacts. A more common method includes fastening the flex circuit to the rigid wired circuit board using a clamping type of connector. These types of connectors typically include plates which either sandwich the flex circuit between the connector and the rigid board or between two plates of a connector, one of which having pins for plugging the connector to a receptacle of the rigid circuit board. These connectors are commonly secured to the rigid board by screws.

In order to couple a flex circuit to these connectors, a back plate is attached to the flex circuit to rigidize its connection "fingers" before it is assembled to mating contacts of the connector. For multilayer flex circuits, the spacing of the fingers are tightly controlled to achieve a high density connector.

SUMMARY OF THE INVENTION

The present invention recognizes the need for an improved flex circuit connector assembly that can be used to interconnect a flex circuit to a rigid circuit board or to another flex circuit while addressing economic considerations for manufacturing and assembling such connectors.

Accordingly, the preferred embodiment of the flex circuit connector assembly includes a male contact portion formed by folding one end of the flex circuit. A row of contact pads is formed on opposite sides of the male contact portion, and is positioned to align with a row of mating contacts disposed within a female socket of an edge connector. Each contact pad can serve as an individual electrical connection in order to achieve a high density connection or can be paired with a contact pad on the opposite side of the male contact portion to increase the contact area and thus the reliability of the connection.

Preferably, the edge connector is a commonly available card-edge connector used for receiving a rigid wired board. Since these connectors are manufactured for receiving a rigid circuit board having a standard thickness, a spacer is used as a gap filler to ensure electrical contact when the male contact portion is inserted into the female socket of the card-edge connector. The flex circuit and the spacer are preferably notched to receive a key located in the female socket of the card-edge connector to ensure proper alignment of the mating connections. The notch in the spacer can be larger than the notch in the flex circuit which is appropriately sized to mate with the key and provide accurate location of the flex circuit contact pads with the mating contacts in the card-edge connector.

BRIEF DESCRIPTION OF THE DRAWINGS

The foregoing and other objects, features and advantages of the invention will be apparent from the following more particular description of the preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
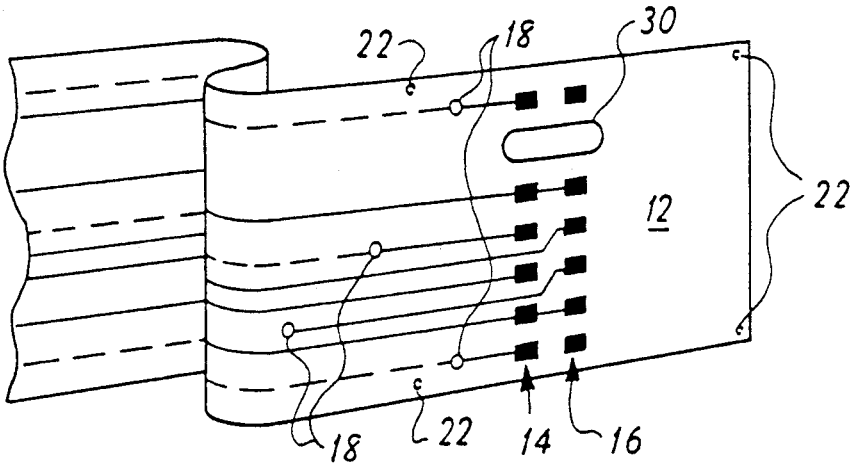
FIG. 1 is a perspective view of a single-sided flex circuit having two rows of contact pads.
Figure 2:
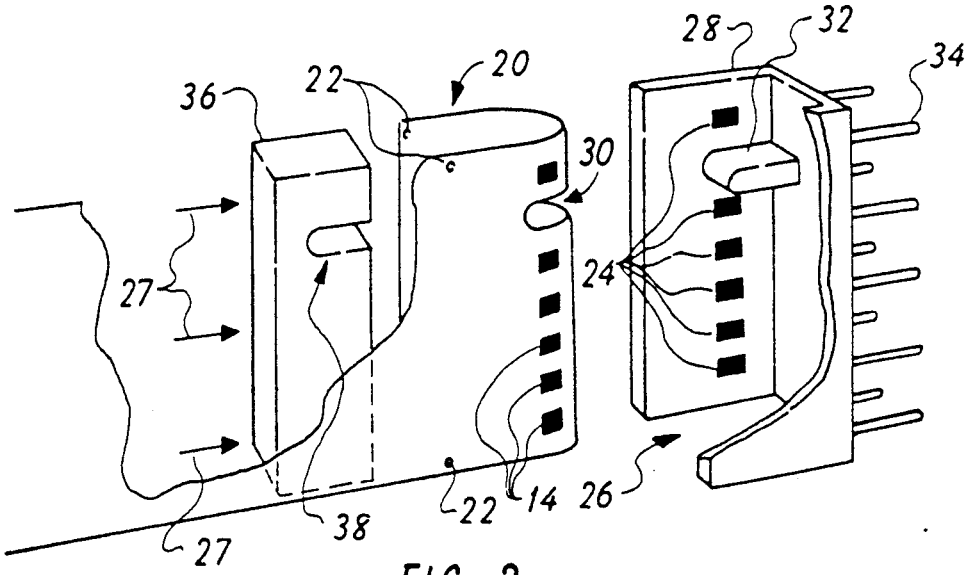
FIG. 2 is an exploded perspective view of a flex circuit connector assembly constructed according to the principles of this invention.

In the preferred embodiment, a flex circuit 10, FIG. 1, is shown having a contact side 12 with two rows of electrical contact pads 14 and 16. The flex circuit can either be a single sided flex circuit or multilayer flex circuit (as shown) having plated through holes 18 for interconnecting leads from other layers (shown as broken lines) to leads (shown as solid lines) on the contact side 12 of the flex circuit. Electrical contact pads 14 and 16 and plated through holes 18 can be formed by any suitable method such as acid etching which is a method commonly employed in the manufacture of flex circuits. A male contact portion 20, FIG. 2, is formed by folding flex circuit 10 between the rows of contact pads 14 and 16. Alignment holes 22 are provided to ensure the proper location of the fold.

Contact pads 14 and 16 are located on flex circuit 10 such that they align and mate with contacts 24 disposed in a female socket portion 26 (shown partially broken away) of an edge connector 28 To ensure that the rows of contact pads 14 and 16 are properly aligned and mated with contacts 24 when male contact portion 20 is inserted in the by arrows 27), a notch 30 is provided for receiving a key 32 formed in female socket 26. The notch can be formed by punching a hole through the flex circuit 10 which is accurately located in relation to the contact pads by any number of conventional tooling techniques. The hole is appropriately sized so that the notch mates with key 32.

The edge connector depicted is a conventional type of a card-edge connector used for connecting a rigid circuit board to another rigid board. As shown, this connector includes pins 34 for mounting it to a receptacle (not shown). Typically, the female socket 26 of this type of connector is designed to receive a rigid board having a standard thickness. Therefore, to ensure a secure fit when the male portion 20 is inserted in female socket 26 of connector 28, a spacer 36 having a thickness predetermined by the thickness of the folded flex circuit and the opening of the female socket portion 26 is provided. Note that the spacer 36 also has a notch 38 for receiving key 32. During assembly, an adhesive may be used to secure the spacer to the flex circuit.

There are several key advantages of this invention. One advantage is that the electrical contact area of the flex circuit can be effectively doubled by interconnecting rows of contact pads. Alternately, each of the pads can serve as independent connections, thereby achieving a high density connection. A combination of independent contact pads and paired contact pads is also possible and is shown in FIG. 1.

Further, male contact portion 20 forms a smooth insertion edge which is suitable for multiple insertions and removals without substantial wear of the contact pads. Conventional rigid circuit boards typically have squared edges which abrade the contact plating of the card-edge connector pads with each insertion into the female socket. Normally, these rigid boards can be inserted into the socket of the connector four or five times before the contact surface area of the pads becomes significantly worn.

Figure 3:
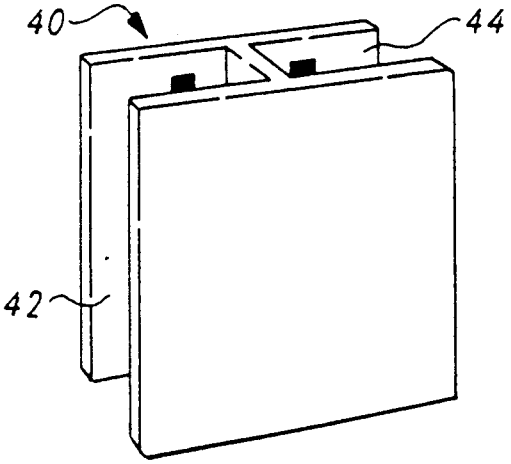
FIG. 3 is a perspective view of a connector having two female sockets for interconnecting two flex circuits.

Another advantage of this flex circuit connector assembly is that the costs associated with manufacturing and assembling it are minimal. The assemblage is a low skilled, low risk operation compared with the soldering of a secondary connector header. Since the method of assembly does not require heat, it is possible to use cheaper materials such as polyester instead of Kapon, which is commonly used in fabricating flex circuits. Further, the design of the assembly takes advantage of established manufacturing techniques for fabricating flex circuits and the use of conventional card-edge connectors currently used only for interconnecting rigid circuit boards. An edge connector 40 may also be formed having two female sockets 42 and 44 as shown in FIG. 3 for interconnecting two flex circuits. These sockets are each essentially identical to socket portion 26 of FIG. 2.

While the invention has been particularly described and shown with reference to a preferred embodiment thereof, it will be understood by those skilled in the art that various changes in form and details may be made therein without departing from the spirit and scope of the invention, as defined by the appended claims. For example, other mechanisms are available for aligning the flex circuit into the female socket portion of the connector. Further, the flex circuit 10 can be formed with either a single row of contacts on one side of the male contact portion 20 or multiple rows on each side. The design will depend on the application.

I claim:

1. A flex circuit connector assembly comprising:

A. a high density flex circuit having multiple layers of electrical leads interconnected to at least one electrical contact pad located on a contact side of a male contact portion, said male contact portion having:

i. a first and second row of contact pads in which at least one pad of said first row is interconnected to a pad in the second row, ii. alignment holes for insuring said flex circuit is folded at a predetermined location between said rows to form said male contact portion at one end of said flex circuit; and iii. a slot for receiving an alignment key;

B. an edge connector having a female socket for receiving the male contact portion to electrically interconnect the contact pads to mating contacts disposed in the female socket, said edge connector further having i. means for mounting it to another wired circuit and ii. a key formed in the female socket of said edge connector for aligning said first and second rows of contact pads with said mating female contacts when said male contact portion is inserted into said female socket; and c. a spacer inserted in the fold of the flex circuit, said spacer having a thickness that insures a secure fit with said male contact portion when it is inserted into the female socket of said edge connector.

2. The flex circuit connector assembly of claim 1, wherein the means for mounting includes a second female socket.

3. The flex circuit connector assembly of claim 1, further comprising means for bonding the spacer to the flex circuit.

4. The flex circuit connector assembly comprising:

A. a high density flex circuit having multiple layers of electrical leads interconnected to at least one electrical contact pad located on a contact side of a male contact portion, said male contact portion having:

i. a first and second row of contact pads, ii. alignment holes for insuring said flex circuit is folded at a predetermined location between said rows to form said male contact portion at one end of said flex circuit, and iii. a slot for receiving an alignment key;

B. an edge connector having a female socket for receiving the male contact portion to electrically interconnect the contact pads to mating contacts disposed in the female socket, said edge connector further having i. means for mounting it to another wired circuit and ii. a key formed in the female socket of said edge connector for aligning said first and second rows of contact pads with said mating female contacts when said male contact portion is inserted into said female socket; and C. A spacer inserted in the fold of the flex circuit, said spacer having a thickness that insures a secure fit with said male contact portion when it is inserted into the female socket of said edge connector.

* * * * *